US009283413B2

(12) United States Patent
Weber et al.

(10) Patent No.: US 9,283,413 B2
(45) Date of Patent: Mar. 15, 2016

(54) FIRE CURTAIN ASSEMBLY AND METHOD OF USE

(71) Applicant: Polo Custom Products, Topeka, KS (US)

(72) Inventors: Brian Michael Weber, Robins, IA (US); Stephen Douglas Blake, Clarksville, TN (US); Mark Allen DeShaw, Hopkinton, IA (US)

(73) Assignee: Polo Custom Products, Topeka, KS (US)

( * ) Notice: Subject to any disclaimer, the term of this patent is extended or adjusted under 35 U.S.C. 154(b) by 0 days.

(21) Appl. No.: 14/676,856

(22) Filed: Apr. 2, 2015

(65) Prior Publication Data

US 2015/0283411 A1 Oct. 8, 2015

Related U.S. Application Data

(60) Provisional application No. 61/974,566, filed on Apr. 3, 2014.

(51) Int. Cl.

| | |
|---|---|
| ***E04H 1/00*** | (2006.01) |
| ***A62C 2/10*** | (2006.01) |
| ***A62C 2/18*** | (2006.01) |

(52) U.S. Cl.

CPC .... *A62C 2/10* (2013.01); *A62C 2/18* (2013.01)

(58) Field of Classification Search

CPC ..... A62C 2/10; A62C 3/0257; A62C 3/0214; E04G 21/30; E04G 21/28; E06B 9/262; E06B 9/264; E06B 9/36; E06B 9/34; E06B 9/521; E06B 9/02; E06B 9/11; E06B 9/13; E06B 9/0692; E06B 9/15; E06B 9/40; E06B 3/80; E04B 1/94; A62B 3/00; E05F 1/065

See application file for complete search history.

(56) References Cited

U.S. PATENT DOCUMENTS

| | | | |
|---|---|---|---|
| 636,113 | A | 10/1899 | Burger et al. |
| 2,305,468 | A | 12/1942 | Ferrigno |
| 2,365,127 | A | 12/1944 | Wagner |
| 2,738,040 | A | 3/1956 | Waldin |
| 2,786,519 | A | 3/1957 | Moore |
| 2,878,906 | A | 3/1959 | Knebel |
| 2,896,753 | A | 7/1959 | Knebel |
| 3,285,593 | A | 11/1966 | Tavernelli et al. |
| 3,762,110 | A | 10/1973 | Boss, Jr. |
| 3,862,876 | A | 1/1975 | Graves |
| 3,946,789 | A | 3/1976 | Ronkholz-Tolle, nee Tolle |
| 4,010,790 | A | 3/1977 | Varga |
| 4,072,140 | A | 2/1978 | Gallagher |
| 4,122,887 | A | 10/1978 | Dussault et al. |
| 4,269,901 | A | 5/1981 | Chamberlain |

(Continued)

*Primary Examiner* — Brian Glessner
*Assistant Examiner* — Gisele Ford
(74) *Attorney, Agent, or Firm* — Christopher A. Proskey

(57) ABSTRACT

A fire curtain assembly is presented that is collapsible for easy transport and quickly and easily assembled for use. This system includes a panel having a plurality of support members positioned in approximate parallel spaced alignment to one another across the panel. The support members have a center section and opposing end sections that selectively connect to the center section thereby forming rigid supports across the panel. End sections have a handle member that connects to a pushrod having a locking pin connected to its end. The locking pin selectively engages and disengages the center section. The handle members have detents that fit within detent sockets thereby holding the handle members in a withdrawn position or an inserted position.

20 Claims, 9 Drawing Sheets

(56) References Cited

U.S. PATENT DOCUMENTS

| | | | | | |
|---|---|---|---|---|---|
| 4,691,753 | A | | 9/1987 | Baier | |
| 4,791,994 | A | | 12/1988 | Ho | |
| 4,836,265 | A | | 6/1989 | Bussert | |
| 4,858,395 | A | | 8/1989 | McQuirk | |
| 4,874,028 | A | * | 10/1989 | Lynch et al. | 160/332 |
| 5,038,889 | A | * | 8/1991 | Jankowski | 182/129 |
| 5,197,239 | A | * | 3/1993 | Glynn et al. | 52/63 |
| 5,265,662 | A | | 11/1993 | Hirao et al. | |
| 5,271,449 | A | | 12/1993 | Herrick | |
| 5,339,883 | A | | 8/1994 | Colson et al. | |
| 5,613,543 | A | * | 3/1997 | Walton | 160/265 |
| 5,704,164 | A | * | 1/1998 | Huang | 49/55 |
| 5,829,200 | A | | 11/1998 | Jones et al. | |
| 5,966,877 | A | | 10/1999 | Hawes | |
| 6,394,172 | B1 | * | 5/2002 | Kessous | 160/264 |
| 6,658,801 | B2 | | 12/2003 | Kilduff et al. | |
| 7,614,187 | B1 | * | 11/2009 | Forbes | 52/202 |
| 7,810,771 | B1 | * | 10/2010 | Akers et al. | 248/200.1 |
| 8,074,700 | B1 | * | 12/2011 | Melino et al. | 160/327 |
| 2002/0046522 | A1 | * | 4/2002 | Kilduff et al. | 52/317 |
| 2004/0035082 | A1 | * | 2/2004 | Hudoba et al. | 52/656.7 |
| 2004/0065799 | A1 | * | 4/2004 | Whittemore et al. | 248/354.1 |
| 2004/0194418 | A1 | * | 10/2004 | Gouley | 52/720.1 |
| 2005/0077015 | A1 | * | 4/2005 | Melino et al. | 160/135 |
| 2007/0094949 | A1 | * | 5/2007 | Pecoraro | 52/127.2 |
| 2010/0170170 | A1 | * | 7/2010 | Quick et al. | 52/202 |
| 2011/0067891 | A1 | * | 3/2011 | Linares | 169/48 |
| 2012/0145418 | A1 | * | 6/2012 | Su et al. | 169/45 |
| 2014/0075851 | A1 | * | 3/2014 | Rhines et al. | 52/63 |
| 2014/0263916 | A1 | * | 9/2014 | Behringer | 248/357 |

* cited by examiner

FIRE CURTAIN ASSEMBLY AND METHOD OF USE

CROSS REFERENCE TO RELATED APPLICATION

This application claims the benefit of U.S. Provisional Application No. 61/974,566 filed Apr. 3, 2014.

FIELD OF THE INVENTION

This invention relates to fire curtain assemblies. More specifically, and without limitation, this invention relates to a collapsible fire curtain assembly used to control and/or reduce air flow into a burning building by firefighters, military personnel or other first responders.

BACKGROUND OF THE INVENTION

Fire is fueled by air. The greater the airflow, the more intense the flames. As such, to successfully fight a fire, airflow into a building must be controlled. However controlling airflow into a burning building can be problematic because windows are often blown out by the fire itself or by persons attempting to escape the fire or signal for help. These new openings in the building provide new avenues for airflow into the building, thereby intensifying the flames. To control the fire, these new openings must be covered.

In order to quickly cover openings in the exterior of a building firefighters use fire curtains. Fire curtains are portable panels of fire resistant material that can be placed in front of openings that cut off or reduce the flow of air through the openings.

While these assemblies provide one manner or method of covering openings, in a building they suffer from a number of deficiencies. Specifically, the existing fire curtain assemblies are cumbersome for firefighters to use because they lack a rigid structure or framework within the fire curtain. In addition, without a rigid structure as part of the fire curtain, existing fire curtains are difficult to install over an opening in the building. Furthermore, existing curtains are difficult and time consuming to implement in an environment where every second counts. Therefore, a need exists in the prior art for an improved fire curtain assembly and method of use.

In view of these deficiencies in the prior art, it is a primary object of the invention to provide a fire curtain assembly and method of use that improves upon the state of the art.

Another object of the invention is to provide a fire curtain assembly and method of use that is easy to transport.

Yet another object of the invention is to provide a fire curtain assembly and method of use that can be quickly and easily implemented.

Another object of the invention is to provide a fire curtain assembly and method of use that is both rigid as well as collapsible.

Yet another object of the invention is to provide a fire curtain assembly and method of use that substantially reduces airflow into a building.

Another object of the invention is to provide a fire curtain assembly and method of use that is inexpensive to manufacture.

Yet another object of the invention is to provide a fire curtain assembly and method of use that has an intuitive design.

Another object of the invention is to provide a fire curtain assembly and method of use that is quickly assembled.

Yet another object of the invention is to provide a fire curtain assembly and method of use that is quickly collapsed.

Another object of the invention is to provide a fire curtain assembly and method of use that has a long useful life.

Yet another object of the invention is to provide a fire curtain assembly and method of use that is rugged and durable.

Another object of the invention is to provide a fire curtain assembly and method of use that can be used in a great number of situations.

Yet another object of the invention is to provide a fire curtain assembly and method of use that can be easily stored within a fire truck.

These and other objects, feature, or advantages will become apparent from the drawings, specification and claims.

SUMMARY OF THE INVENTION

A fire curtain assembly is presented that is collapsible for easy transport and quickly and easily assembled for use. This system includes a panel having a plurality of support members positioned in approximate parallel spaced alignment to one another across the panel. The support members have a center section and opposing end sections that selectively connect to the center section thereby forming rigid supports across the panel. End sections have a handle member that connects to a pushrod having a locking pin connected to its end. The locking pin selectively engages and disengages the center section. The handle members have detents that fit within detent sockets thereby holding the handle members in a withdrawn position or an inserted position.

Figure 1:
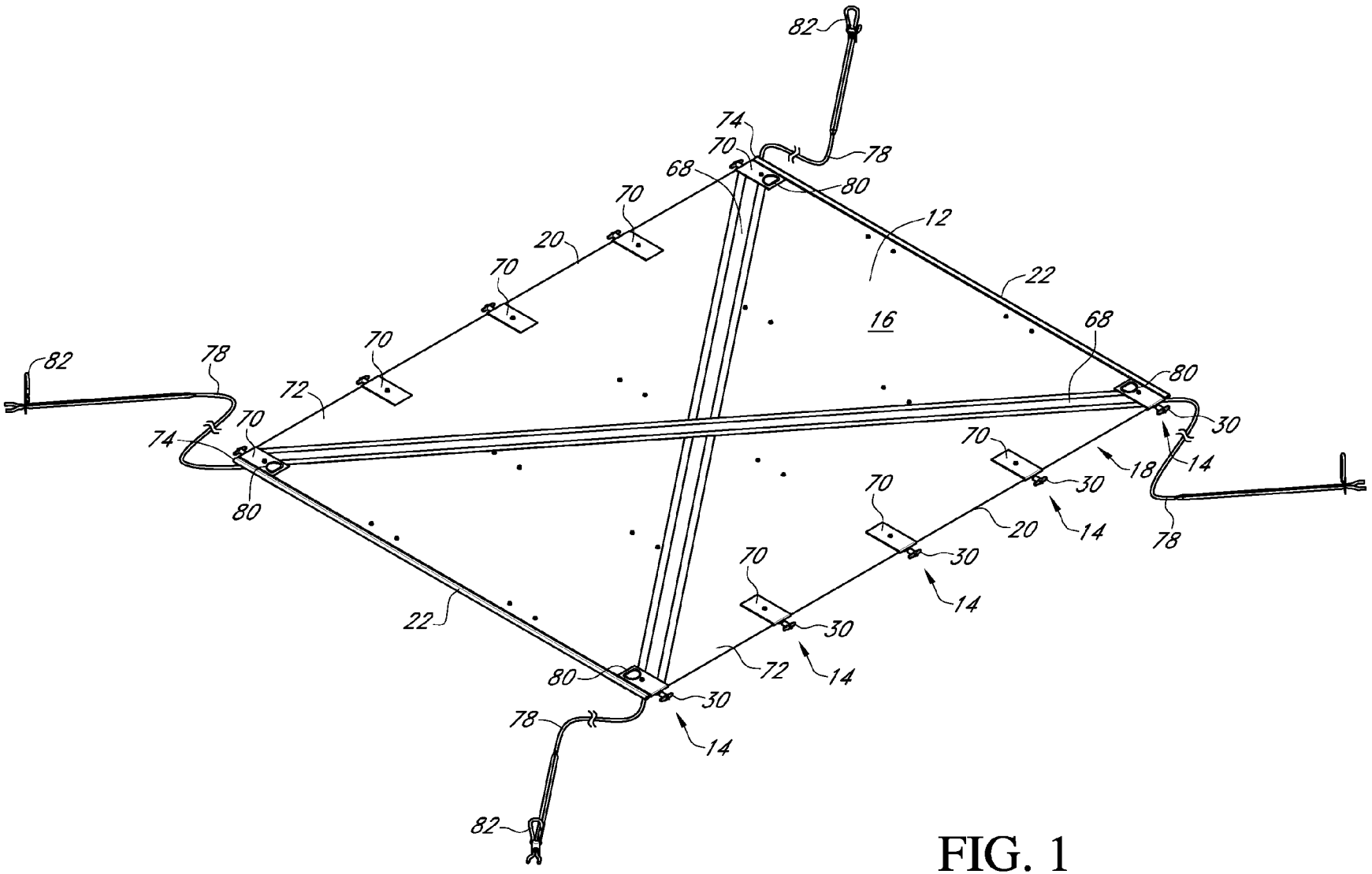
FIG. 1 is a perspective view of a fire curtain assembly formed of a panel of fabric having a plurality of support members that extend across the panel and form rigid supports when in a deployed position while allowing for folding of the panel when in a retracted position, the view showing the panel in a deployed position.

DETAILED DESCRIPTION OF THE INVENTION:

In the following detailed description, reference is made to the accompanying drawings which form a part hereof, and which is shown by way of illustration specific embodiments in which the invention is practiced. These embodiments are described in sufficient detail to enable those skilled in the art to practice the invention, and it is to be understood that other embodiments may be utilized that mechanical, procedural, and other changes may be made without departing from the spirit and scope of the inventions. The following detailed description is, therefore, not to be taken in a limiting sense, and the scope of the invention is defined only by the appended claims, along with the full scope of equivalents to which such claims are entitled.

With reference to the figures, a fire curtain assembly 10 is presented. The fire curtain assembly is formed of any suitable size, shape and design. In the arrangement shown, as one example, fire curtain assembly 10 is formed of a panel 12 having a plurality of collapsible support members 14 that extend across and/or through the panel 12. While one panel 12 is shown, the use of any number of layers is hereby contemplated for use.

Panel 12 is formed of any suitable size, shape and design and serves to cover an opening in a building to prevent airflow into the building. In the arrangement shown, panel 12 is formed of a generally square or rectangular piece of flexible material such as fabric, canvas, composite, or any other material, or alternatively, panel 12 is formed of a rigid material that is connected in a flexible manner, such as links or the like. In one arrangement, due to the high heat applications, panel 12 is formed of a heat-resistant material such as treated fabric, treated canvas, an aramid or any other heat resistant material or material that endures high-heat applications. Also, to prevent airflow into the building, panel 12 is formed of a material that is air-tight, sealed or non-porous and therefore prevents or reduces airflow through the panel 12. Panel 12 has an outward facing surface 16, an inward facing surface 18 and a pair of opposing sides 20 and opposing ends 22.

Support members 14 are formed of any suitable size, shape and design and serve to provide rigidity to the flexible panel 12 while allowing panel 12 to be folded. In the arrangement shown, as one example, support members 14 are formed of generally elongated members that extend from side 20 to side 20 of panel 12. In the arrangement shown, support members 14 are formed of a plurality of sections. As is shown, support members are formed of a center section 24 with an end section 26 positioned on each outward side of the center section 24. However, any number of sections is hereby contemplated for use such as one, two, four, five or more.

In the arrangement shown, center section 24 and end sections 26 include a frame member 28. Frame member 28 is formed of any suitable size, shape and design. As one example, as is shown, frame member 28 is a generally circular hollow tubular member that provides rigid structural support to panel 12. However any other shape or design of a member is hereby contemplated for use such as a rectangular tube, square tube, oval tube, hexagonal tube, an I-beam, a framed member, a plurality or combination of any of these elements, or the like. A handle member 30 is connected to the outward ends of end sections 26 and is connected to a pushrod 32 that extends through frame member 28.

Handle member 30 is formed of any suitable size, shape and design. In the arrangement shown, handle member 30 is formed of a main body 34 that is sized and shaped to slidably fit within the outward end of frame member 28 of end section 26 with close and tight tolerances. In the arrangement wherein frame member 28 is a circular tube, main body 34 is similarly circular in shape and fits within the circular hollow interior of frame member 28. The inward end of main body 34 extends a distance within the hollow interior of frame member 28 whereas the outward end of main body 34 extends outwardly from frame member 28 a distance.

A handle section 36 is connected to the outward end of main body 34. Handle section 26 is formed of any suitable size, shape and design, and is used for conveniently and comfortably gripping by a user. In the arrangement shown, handle section 36 is formed of a socket 38 that is sized and shaped to engage and fit over the outward end of main body 34 and a T-section 40 that extends outwardly from socket 38 in a generally perpendicular or T-shaped manner to the length of main body 34.

Handle member 30 also includes a pushbutton 42 that is operatively connected to one or more detent members 44. Detent members 44 are any device that moves between an extended position and a retracted position. In an extended position, detent members 44 lock handle member 30 in place or prevents or resists movement of handle member 36, whereas in a retracted position detent members 44 allow for free movement of handle member 30. Pushbutton 42 is any device that operates detent members 44. In the arrangement shown, pushbutton 42 is a generally round or circular push button that extends outward from the end of socket section 38 or the center of T-section 40, and detent members 44 are a pair of ball bearings. In this arrangement, when pushbutton 42 is depressed, the ball bearing detent members 44 are refracted below the surface of main body 34 thereby allowing for free movement and sliding of main body 34 within the hollow interior of frame member 28. In contrast, when pushbutton 42 is not depressed, the ball bearing detent members 44 protrude from the surface of main body 34 an amount or distance and engage the inner surface of the hollow interior of frame member 28 thereby preventing or resisting movement of main body 34.

In the arrangement shown, detent members 44 are positioned at or near the inward end of main body 34 and are placed on opposite sides of main body 34. To facilitate locking of the handle member 30 in an inserted position an inward set of detent sockets 46 are positioned to receive detent members 44 when handle member 30 is in a fully inserted position within frame member 28. Similarly, to facilitate locking of the handle member 30 in a retracted position an outward set of detent sockets 48 are positioned to receive detent members 44 when handle member 30 is in a fully retracted position within frame member 28.

The inward end of main body 34 is connected to the outward end 50 of pushrod 32 by any method or means. In one arrangement, main body 34 is removably connected to pushrod 34 by a threaded engagement, a snap-fit engagement or by any other removable manner, whereas in another arrangement the inward end of main body 34 is permanently or non-removably affixed to pushrod 34 such as by welding, machining the two components out of a single piece of material or the like. Due to this connection, as the handle member 30 is moved within the frame member 28, so moves the pushrod 32. That is, when the handle member 30 is in the inserted position, as is shown in FIG. 5, the pushrod 42 is in the inserted position, as is shown in FIG. 6; when the handle member 30 is in the retracted position, the pushrod 42 is in the withdrawn position, as is shown in FIG. 7.

Pushrod 32 is formed of any suitable size, shape and design. In the arrangement shown, pushrod 32 is formed of a generally circular elongated member that extends through the hollow interior of frame member 28 and facilitates locking of support member 14 in an extended position and unlocking of support member 14 to facilitate folding of fire curtain assembly 10. A circular pushrod 32 is shown only as an example and it is hereby contemplated to form pushrod 32 out of any other shape such as a square or rectangular bar, a circular, square or rectangular tube, or any other shaped member.

The outward end 50 of pushrod 32 is connected to the inward end of main body 34 of handle member 30. The inward end 52 of pushrod 32 is connected to a locking pin 54. Locking pin 54 is formed of any suitable size, shape and design and serves to connect the inward end of end sections 26 to the outward end of center section 24. In the arrangement shown, locking pin 54 has a generally cylindrical exterior surface that is sized and shaped to fit within the hollow interior of frame member 28 within close and tight tolerance while allowing locking pin 54 to slide into and out of frame member 28. As is also shown, locking pin 54 has a hollow bore 56 that threadably receives the threaded inward end 52 of pushrod 32 such that when pushrod 32 moves, so moves locking pin 54. The inward end of locking pin 54 has a rounded or angled nose 58 that facilitates or eases insertion and alignment of locking pin 54 into the open end of frame member 28 of center section 24. To further ease or facilitate insertion and alignment of nose 58 of locking pin 54 into the hollow interior of center section 24, the end of the hollow interior of center section 24 has a bore 60 that is slightly larger than the other portions of the hollow interior.

Figure 5:
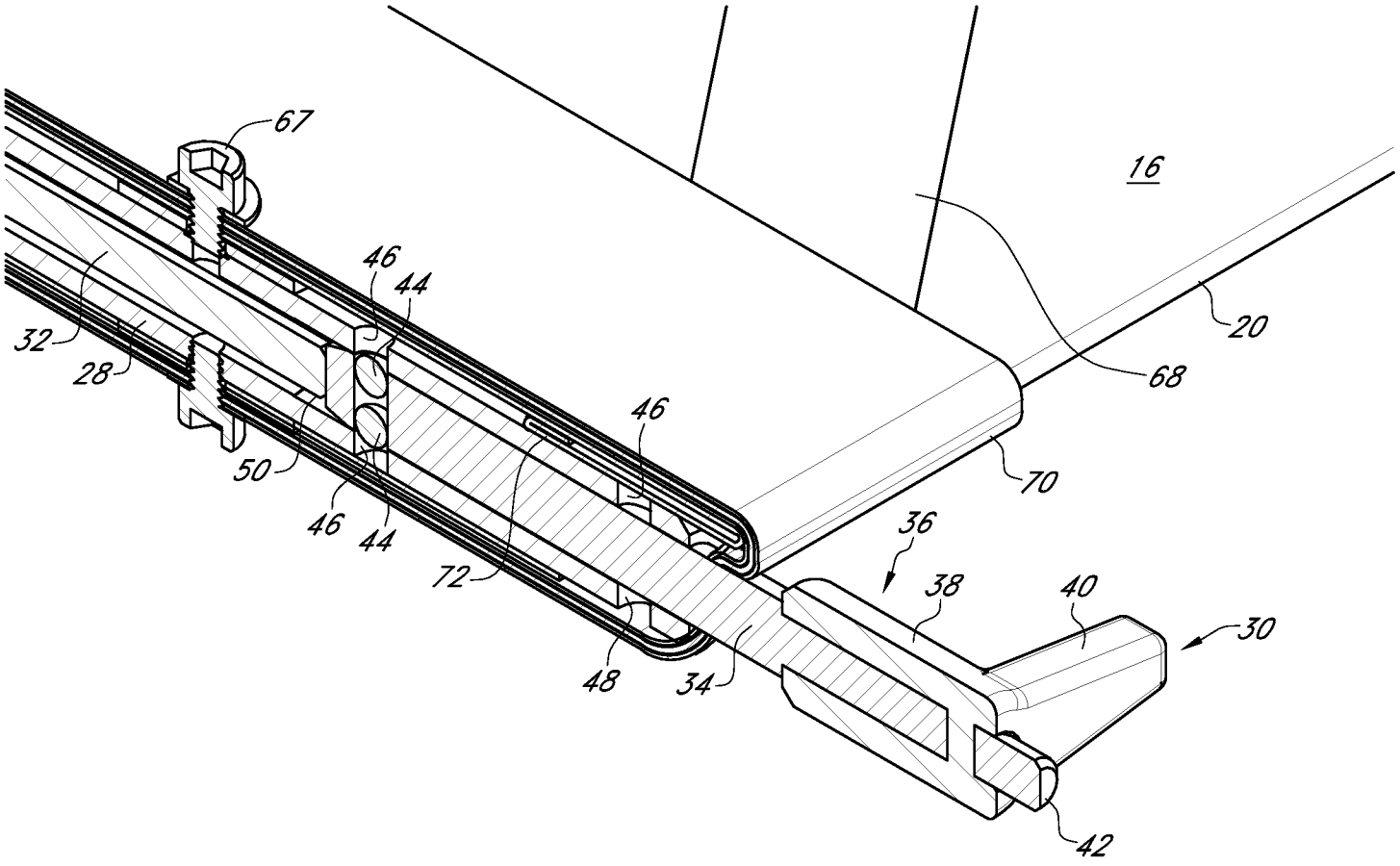
FIG. 5 is a close up perspective cut-away view of FIG. 4, the view showing the end section within the side cover, the view showing the pushrod within the exterior member and the detent sockets and detent members of the handle member.
Figure 6:
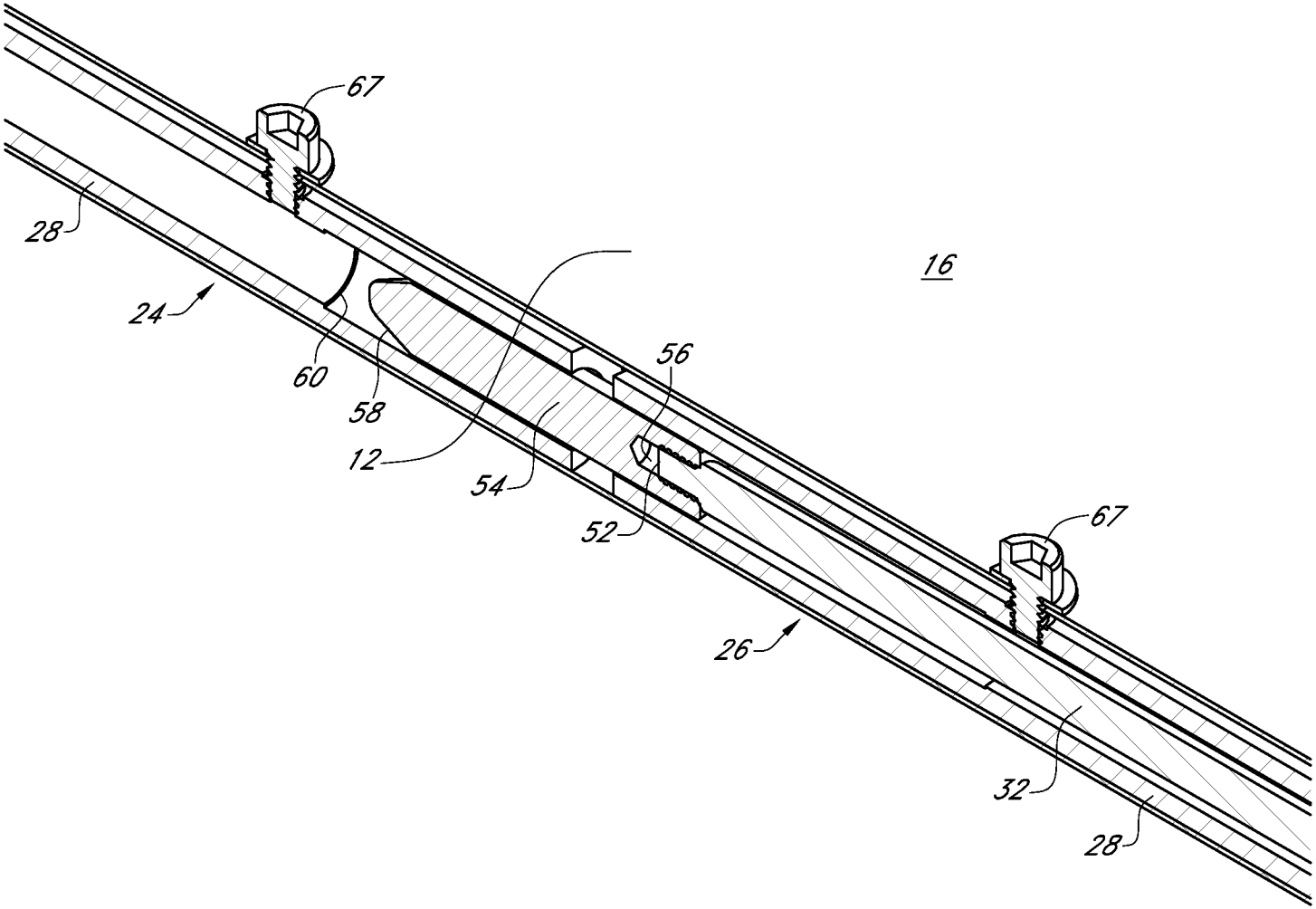
FIG. 6 is a close up perspective cut-away view of an end section connecting to a center section, the view showing the locking pin of the end section inserted within the hollow interior of the frame member of the center section.
Figure 7:
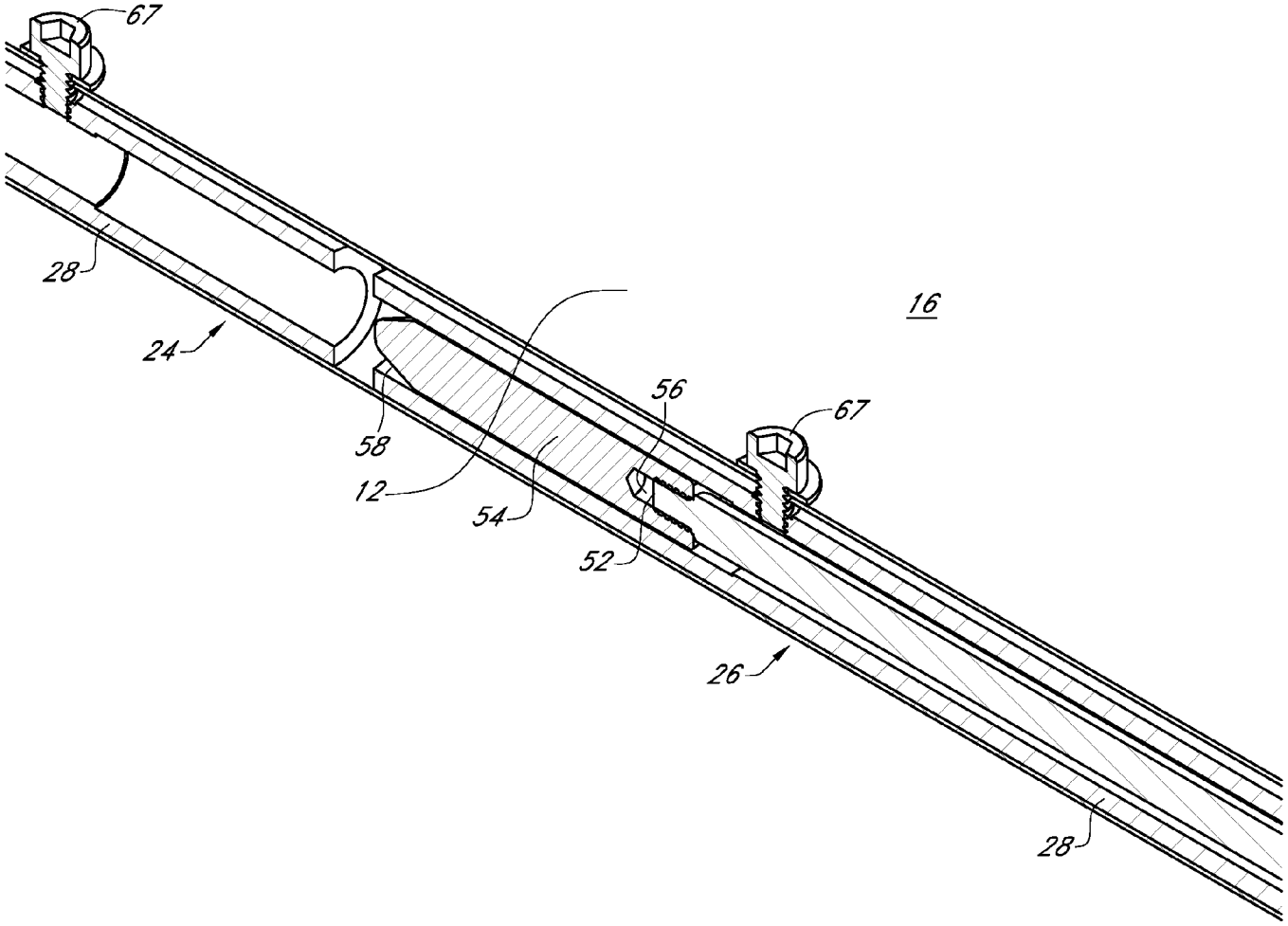
FIG. 7 is a close up perspective cut-away view of an end section disengaged from a center section, the view showing the locking pin pf the end section withdrawn from within the hollow interior of the frame member of the center section.
Figure 8:
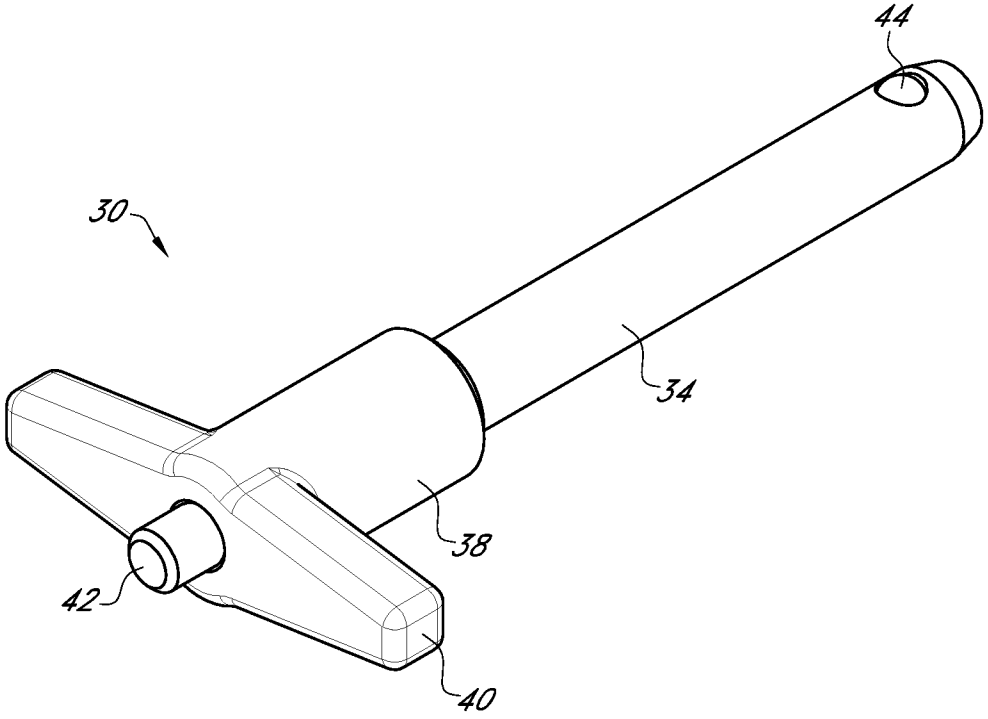
FIG. 8 is a close up perspective view of a handle member.

As locking pin 54 is connected to pushrod 32 which is connected to handle member 30, when the handle member 30 is in the inserted position, as is shown in FIG. 5, the pushrod 42 is in the inserted position and the locking pin 54 is inserted within the center section 24, as is shown in FIG. 6 thereby facilitating locking of the end section 26 with the center section 24. In contrast, when the handle member 30 is in the retracted position, the pushrod 42 is in the withdrawn position and the locking pin 54 is withdrawn from the center section 24, as is shown in FIG. 7, thereby allowing the panel 12 to be folded.

In one arrangement, to facilitate connection of center sections 24 and end sections 26 to panel 12 as well as to help maintain alignment of center sections 24 and end sections 26 with one another, rivet plates 62 are connected to center sections 24 and end sections 26 adjacent their ends. Rivet plates 62 are formed of any suitable size, shape and design. In the arrangement shown, rivet plates 62 are generally planar in shape, and in one arrangement square or rectangular in shape, and include one or more openings 64 therein that receive connecting members therein such as rivets, screws, bolts or the like, that connect center sections 24 and end sections 26 to panel 12. As one example, a rivet plate 62 is connected adjacent each end of each center section 24 and end section 26. These rivet plates 62 are aligned in planar alignment to one another such that when panel 12 is laid flat, the connection of rivet plates 62 to panel 12 helps to align center sections 24 and end sections 26 so as to allow for quick and easy insertion of locking pins 54 within center section 24.

Center sections 24 and end sections 26 are connected to panel 12 by any manner or method. In one arrangement, as is shown, center sections 24 and end sections 26 are connected to panel 12 in end-to-end alignment with one another such that the center axis of center sections 24 and end sections 26 are aligned with one another. In this position, the center sections 24 are approximately centrally aligned with panel 12 and the outward ends of end sections 26 are approximately aligned with the sides 20 of panel 12.

In one arrangement, center sections 24 and end sections 26 are riveted to panel 12 using conventional rivets, or screws or bolts through panel 12 and rivet plates 62. To provide improved durability, a retaining strip 66 is placed over the aligned center sections 24 and end sections 26 which is connected to panel 12 on both sides of center sections 24 and end sections 26 thereby trapping center sections 24 and end sections 26 within the pocket formed by the connection of retaining strip 66 to panel 12. Retaining strip 66 is connected to panel 12 by any manner or method such as stitching, sewing, adhering, welding or the like. In one arrangement, retaining strip 66 is formed of the same or similar material to that which forms panel 12. In an alternative arrangement, retaining strip 66 is formed of a stiffening material or a material that is substantially stiffer than the material which forms panel 12, such as plastic, composite, PVC, an aramid, UHMW, UHMWPE, or any other stiffened material or stiffened fabric. Holding center sections 24 and end sections 26 within the pocket formed by retaining strips 66 both protects center sections 24 and end sections 26 as well as helps to align center sections 24 and end sections 26 with one another when panel 12 is unfolded thereby helping to facilitate quick and easy insertion of locking pins 54 within center sections 24.

Figure 9:
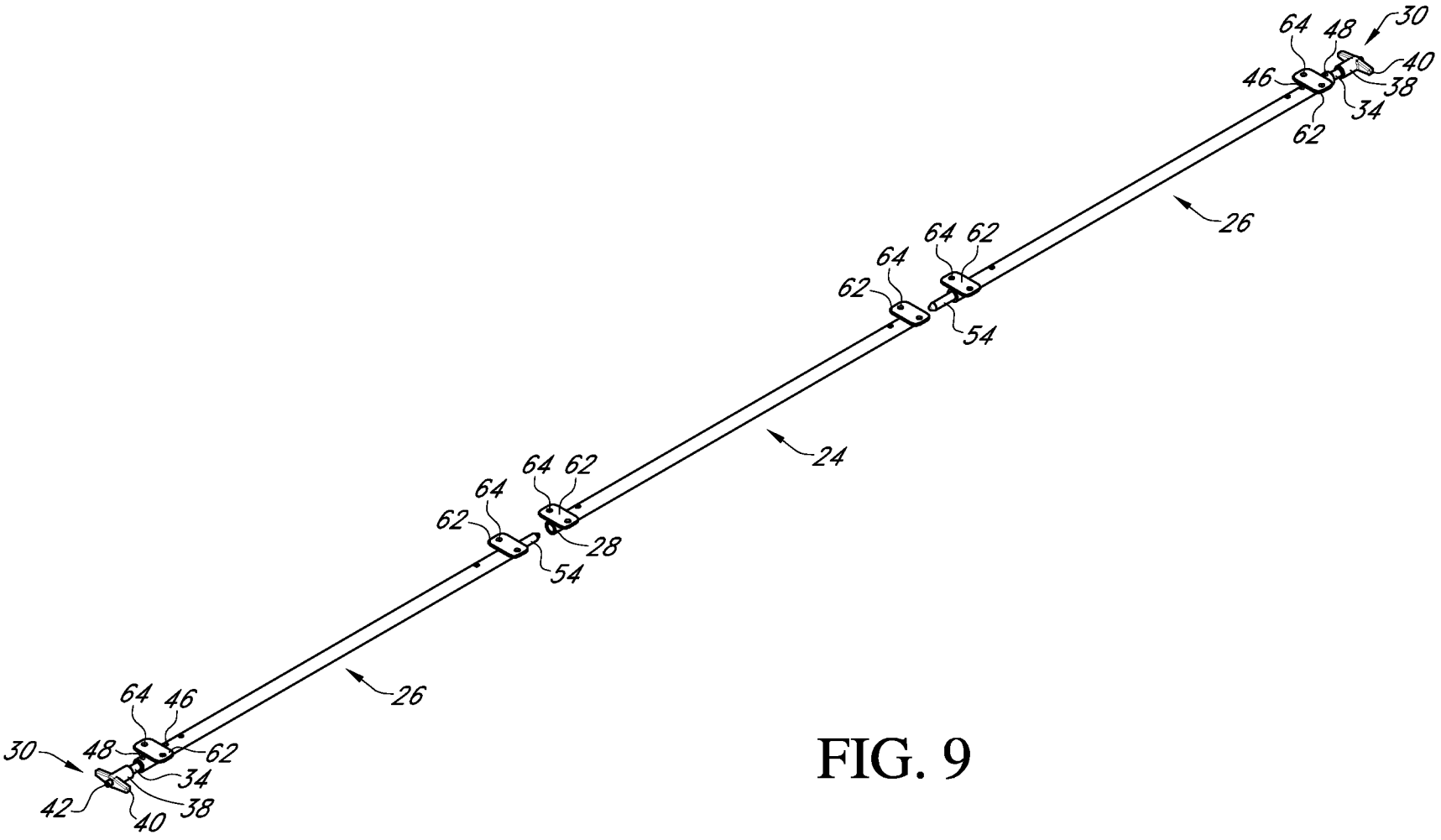
FIG. 9 is a perspective exploded view of a support member, the view showing the end sections having deployed locking pins, the view also showing the detent sockets and rivet plates.

While rivet plates 62, as are shown in FIG. 9, are effective at attaching panel 12 to center sections 24 and end sections 26, using rivet plates 62 requires an additional part, the rivet plate 62 itself, as well as an additional manufacturing step to attach the rivet plate 62 to the center sections 24 and end sections 26. In addition, when center sections 24 and end sections 26 are formed of titanium, or another material that is difficult to weld or machine, the addition of rivet plates 62 can become costly and time consuming. As an alternative arrangement to adding the rivet plates 62, as is shown in FIGS. 5-7, holes are machined into the center sections 24 and end sections 26 and fasteners 67 are used to connect panel 12 to center sections 24 and end sections 26. In one arrangement, as is shown, fastener 67 is a threaded screw or bolt having a head with an extended surface area that threadably engage a threaded hole in the center sections 24 and end sections 26. Alternatively, a washer is positioned between the head of fastener 67 and panel 12 to increase the surface area to prevent tearing of panel 12 as well as improve durability. Fasteners 67 help to serve the same purpose of rivet plates 62, which is to maintain the alignment of center sections 24 and end sections 26. In yet another alternative embodiment, a joint or hinge is connected between the ends of center sections 24 and end sections 26 thereby further helping to maintain alignment.

Cross connectors 68 are connected to the outward facing surface 16 and/or the inward facing surface 18 of panel 12. Cross connectors 68 are strips of fabric connected to panel 12 by any manner or method such as stitching, sewing, adhering, welding or the like. Cross connectors 68 extend from corner of panel 12 to corner of panel 12 in an X fashion. Cross connectors 68 provide additional strength and durability to panel 12 as they pass forces diagonally across panel 12. In addition, in one arrangement, cross connectors 68 are formed of a colorful and/or reflective material that allows for improved visibility of fire curtain assembly 10, especially in low light situations.

To provide additional strength, rigidity and durability to the support members 14, especially at the outward ends of end sections 26, side covers 70 are placed over the outward ends of end sections 26. Side covers 70 are formed of any suitable size, shape and design. In one arrangement, side covers 70 are formed of a square or rectangular panel of fabric or material that is centered on the outward end of end sections 26 and is connected to the outward facing surface 16 and inward facing surface 18 of panel 12. Handle member 30 extends through side cover 70 to the frame member 28 held within the side cover 70. Side covers 70 are connected to panel 12 by any manner or method such as stitching, sewing, adhering, welding or the like. In one arrangement, side covers 70 are formed of the same or similar material to that which forms panel 12 and provide additional strength or rigidity by additional an additional layer of material. In an alternative arrangement, side cover 70 is formed of a stiffening material or a material that is substantially stiffer than the material which forms panel 12, such as hard or stiff plastic, composite, PVC, an aramid, UHMW, UHMWPE, or any other stiffened or hardened material or stiffened fabric.

A stiffening member 72 is connected to the sides 20 of panel 12. Stiffening member 72 is any device which provides additional stiffness to the sides 20 of panel 12 while still allowing panel 12 to be folded. Stiffening member 72 is connected to panel 12 by any manner or method such as stitching, sewing, adhering, welding or the like.

In one arrangement, stiffening member 72 is a piece of flexible metal or plastic or composite. Whereas, in another arrangement stiffening member 72 is simply another layer, fold or piece of fabric attached at the side 20 of panel 12.

In the arrangement shown, an end loop 74 is connected to the ends 22 of panel 12. End loop 74 is a loop of fabric connected to ends 22 thereby forming a passageway 76 there through, such as for rope or cable 78.

One or more ropes or cables 78 are connected to fire curtain assembly 10. Ropes or cables 78 are connected to fire curtain assembly by any manner or method. In one arrangement, one or more connection members 80 are connected to fire curtain assembly 10. In one arrangement, connection members 80 are loops of material, metallic rings, grommets, or any other device to which ropes or cables 78 can be connected to, clipped to, or passed through. In one arrangement, a connection member 80 is connected to each corner of fire curtain assembly 10 and a rope or cable 78 extends outward from each corner of fire curtain assembly 10 to facilitate placement and connection of fire curtain assembly 10 in use. In one arrangement, a clip or carabineer 82 is connected to the end of each rope or cable 78.

Figure 2:
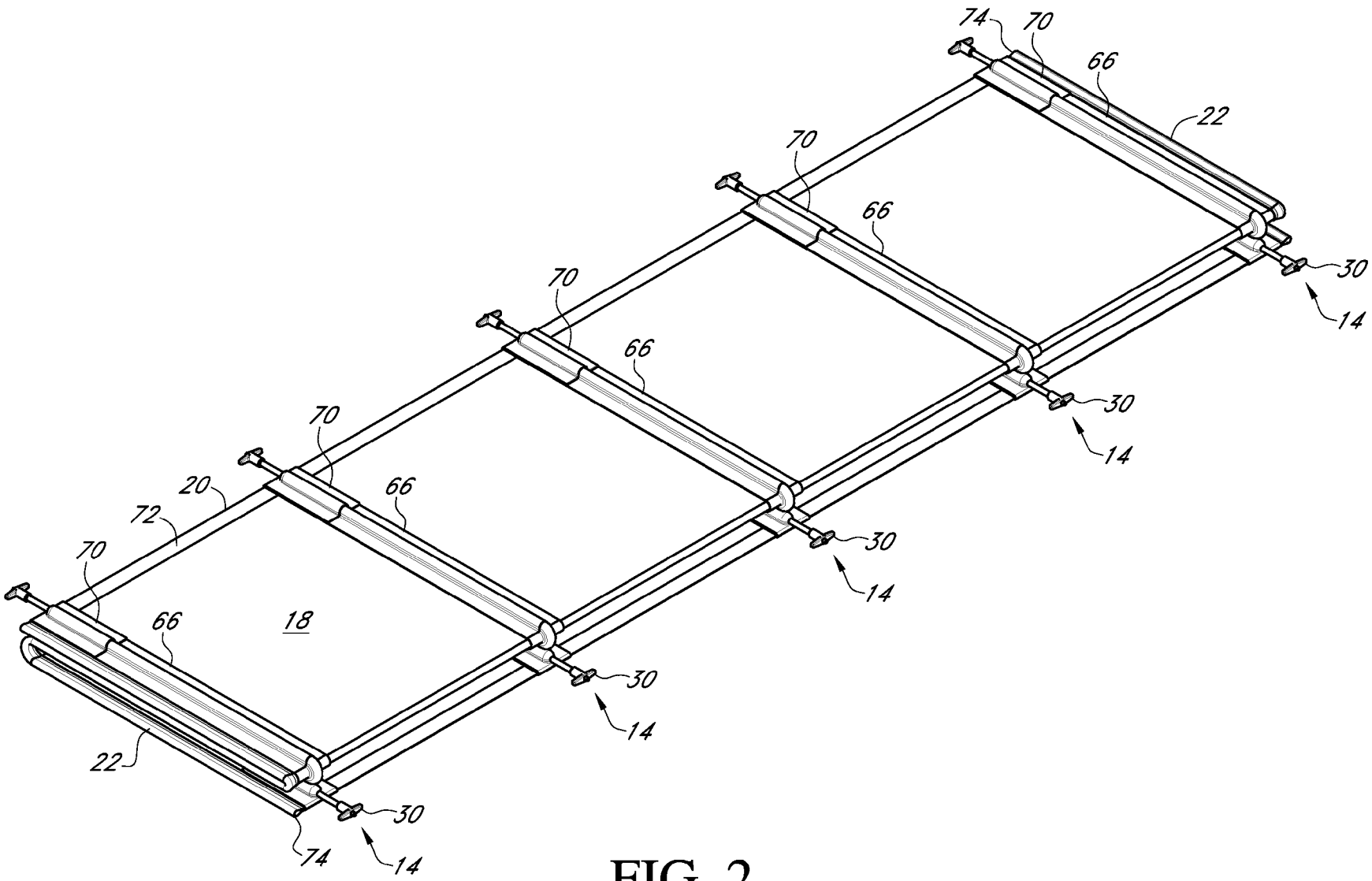
FIG. 2 is a perspective view of a fire curtain assembly formed of a panel of fabric having a plurality of support members that extend across the panel and form rigid supports when in a deployed position while allowing for folding of the panel when in a retracted position; the view showing the panel in a partially folded position.
Figure 3:
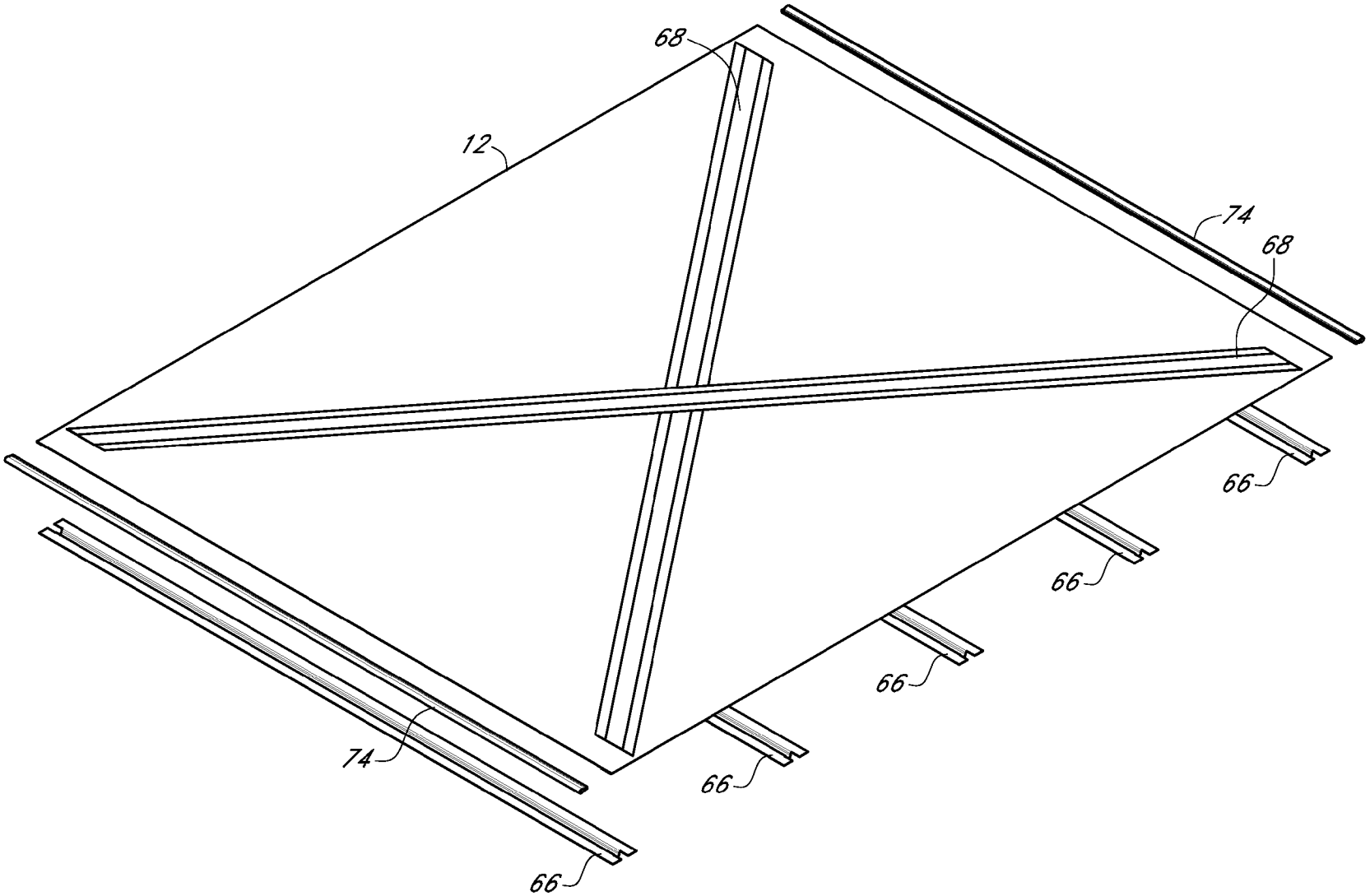
FIG. 3 is an exploded perspective view of the panel of fabric, the view showing cross connectors, retaining strips and end loops.
Figure 4:
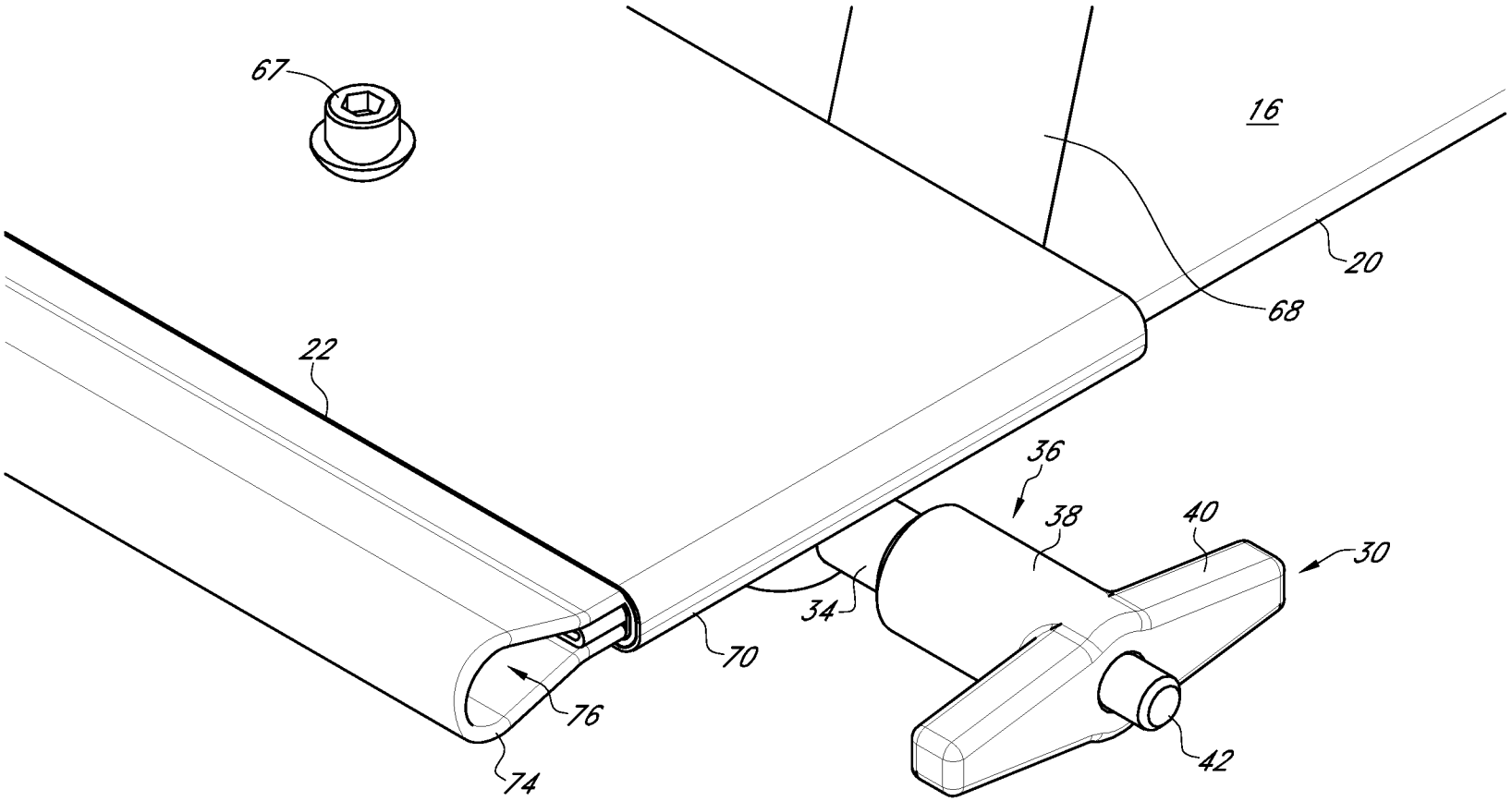
FIG. 4 is a close up perspective view of a corner of a fire curtain assembly, the view showing a handle member, an end loop connected to the end of the panel and a side cover covering the end of the support member.

In Operation: The fire curtain assembly 10 presented converts between a folded position, as is shown in FIG. 2, where it is easily transported, to an unfolded position, as is shown in FIG. 1, where it is used to prevent or reduce airflow into a burning building.

Fire curtain assembly 10 is stored in a folded position with the locking pins 54 of end sections 26 withdrawn from the hollow interiors of end sections 26. To convert the fire curtain assembly 10 from a stored position to a deployed position, the fire curtain assembly 10 is removed from its carrying bag or case and laid out on the ground in a generally flat and extended position.

In one arrangement, where the pushrods 32 and locking pins 54 are spring loaded to be in the extended position such that the locking pins 54 protrude out of the inward end of end sections 26, as the panel 12 is laid out flat, and the outward end of center sections 24 are aligned with the inward ends of end sections 26 and the locking pins 54 automatically are inserted within the hollow interior of center sections 24. This spring-loaded arrangement provides quick and easy assembly of the fire curtain assembly 10.

In an alternative arrangement, wherein the pushrods 32 and locking pins 54 are not spring loaded to automatically insert themselves within the hollow interior of center sections 24, once the panel 12 is laid flat the handle members 30 are forced inward. This is accomplished in one arrangement by depressing pushbutton 42 which withdraws detent members 44 from the outward detent sockets 48 which allows the pushrod 32 and locking pin 54 to slide into the hollow interior of center section 24 either under a spring-loaded force or by the application of an external force by the person assembling the fire curtain assembly 10.

In yet another alternative arrangement, instead of depressing pushbutton 42, the assembler merely applies an external force that overcomes the engagement of the detent members 44 and the detent sockets 48. Once this force is applied, the pushrod 32 and locking pin 54 are moved by the assembler's own force or under a spring loaded force until the locking pin 54 is inserted within the hollow interior of the center section 24.

This process is repeated for all support members 14. Once all support members 14 are assembled, such that the locking pin 54 of each end section 26 is inserted within the hollow interior of its respective center section 24, the fire curtain assembly 10 is ready for use. Ropes or cables 78 are attached to connection members 80 and adjusted appropriately and the ropes or cables 78 attached to panel 12 are used to maneuver the fire curtain assembly 10 in place over a blown out window in a burning building.

Once in place, the ropes or cables 78 are used to hold the fire curtain assembly in place. During use, the cross connectors 68 help to distribute forces across the panel 12, the assembled support members 14 help to prevent collapse of the panel 12, and the stiffening members 72 help to keep the edges rigid between support members 14.

Once the fire curtain assembly 10 is no longer needed, the fire curtain assembly 10 is lowered and each support member 14 is disassembled. Support members 14 are disassembled by either depressing pushbutton 42 which causes detent members 44 to withdraw from inward detent sockets 46 or alternatively by applying an external force that overcomes the engagement of the detent members 44 and the detent sockets 46. Once the detent members 44 and the detent sockets 46 are disengaged the handle member 30 is pulled outward until the detent members 44 reengage the outward set of detent sockets 48 thereby holding the handle member 30, pushrod 32 and locking pin 54 in a withdrawn position where the locking pin 54 is disengaged from the center section 24.

Once all of the support members 14 are placed in this position wherein the locking pins 54 are disengaged from their respective center section 24 the panel 12 can then be folded and stored away.

From the above discussion it will be appreciated that the fire curtain assembly 10 shown and described herein improves upon the state of the art.

Specifically, the fire curtain assembly 10 is easy to transport; can be quickly set in place; is both rigid as well as collapsible; substantially reduces airflow into a building; is inexpensive to manufacture; has an intuitive design; is quickly assembled; is quickly collapsed; has a long useful life; is rugged and durable; can be used in a great number of situations; can be easily stored within a fire truck; among countless other features or advantages.

Thus, one of ordinary skill in the art would easily recognize that all the stated objectives have been accomplished.

It will be appreciated by those skilled in the art that other various modifications could be made to the device without parting from the spirit and scope of this invention. All such modifications and changes fall within the scope of the claims and are intended to be covered thereby.

What is claimed:

1. A fire curtain assembly, comprising:

a flexible panel of material;

a first support member connected to the panel;

the first support member having a center section a first end section and a second end section;

the first end section having a first locking pin that selectively engages a first end of the center section;

the first end section having a first handle member and a pushrod that is operatively connected to the first locking pin, wherein the first handle member moves the pushrod which moves the first locking pin between an engaged position and a disengaged position;

the second end section having a second locking pin that selectively engages a second end of the center section; and wherein the first support member converts between:

a collapsed position wherein the first locking pin of the first end section and the second locking pin of the second end section are withdrawn from engagement with the center section, and a deployed position wherein the first locking pin of the first end section and the second locking pin of the second end section are engaged with the center section thereby forming a rigid first support member.

2. The fire curtain assembly of claim 1 wherein the first support member is held within a retaining strip connected to the panel.

3. The fire curtain assembly of claim 1 further comprising a second handle member connected to the second end section that facilitates movement of the second locking pin between an engaged position and a disengaged position.

4. The fire curtain assembly of claim 1 wherein the first handle member includes at least one detent member that engages a detent socket in the first end section.

5. The fire curtain assembly of claim 1 wherein the first locking pin of the first end section is received within a hollow bore of the center section.

6. The fire curtain assembly of claim 1 further comprising a pair of rivet plates connected to the center section.

7. The fire curtain assembly of claim 1 further comprising a pair of rivet plates connected to the first end section and the second end section.

8. The fire curtain assembly of claim 1 wherein the first support member includes a plurality of fasteners that connect the panel to the first support member.

9. The fire curtain assembly of claim 1 wherein the first support member includes a plurality of holes that threadably receive fasteners that connect the panel with the first support member.

10. The fire curtain assembly of claim 1 further comprising a rope or cable connected to the panel.

11. The fire curtain assembly of claim 1 further comprising cross connectors that extend across the panel from corner to corner.

12. The fire curtain assembly of claim 1 wherein the panel of material is formed of a heat resistant material.

13. A fire curtain assembly that converts between a collapsed position and a deployed position, comprising;

a panel of material;

a plurality of support members positioned in parallel spaced alignment across the panel;

wherein the plurality of support members are formed of a first section and a second section;

wherein the first sections and second sections convert between:

a disengaged position, wherein the support members are capable of being folded, and an engaged position wherein the support members form a rigid member that extends across a length of the panel;

wherein the first sections have a handle member, pushrod and a locking pin;

wherein the locking pin selectively engages the second section in the engaged position;

wherein the handle member and push rod are operatively connected to the locking pin and configured to move the locking pin between the engaged position and the disengaged position.

14. The fire curtain assembly of claim 13 wherein the first sections include at least one detent member that serves to hold the locking pin in place.

15. The fire curtain assembly of claim 13 wherein the handle member includes a pushbutton.

16. A fire curtain assembly, comprising:

a panel;

a support member connected to the panel;

the support member having a first section and a second section;

the first section having a handle, a push rod and a locking pin;

wherein the handle moves the push rod which moves the locking pin between a disengaged position and an engaged position;

wherein when in a disengaged position, the locking pin is disengaged from the second section thereby allowing folding of the panel; and wherein when in an engaged position, the locking pin is engaged with the second section thereby forming a rigid support member within the panel.

17. The fire curtain assembly of claim 16 wherein the locking pin of the first section engages a hollow bore of the second section in an engaged position.

18. The fire curtain assembly of claim 16 wherein the locking pin of the first section is retracted from a hollow bore of the second section in a disengaged position.

19. A collapsible fire curtain assembly, comprising:

a panel;

a plurality of support members connected to the panel;

the plurality of support members having a first section and a second section;

the first sections having a locking pin that selectively engages the second sections; wherein the first sections have a handle member and a pushrod operably connected to the locking pin and configured to move the locking pin between an engaged position and a disengaged position;

wherein the panel converts between a folded position, where it is easily transported, and an unfolded position;

wherein when the panel is unfolded, the locking pins of the first sections automatically engage the second sections thereby forming rigid support members that provide support to the panel.

20. The collapsible fire curtain assembly of claim 19, wherein the plurality of support members further having a third section;

the third sections having a locking pin that selectively engages the second sections;

wherein when the panel is unfolded, the locking pins of the third sections automatically engage the second sections thereby forming rigid support members that provide support to the panel.

* * * * *